United States Patent [19]

Corbett et al.

[11] Patent Number: 4,779,669

[45] Date of Patent: Oct. 25, 1988

[54] FEEDER SLEEVES

[75] Inventors: Clifford F. Corbett, Walsall, United Kingdom; Helmut Schopp, Borken, Fed. Rep. of Germany

[73] Assignee: Foseco International Ltd., Birmingham, England

[21] Appl. No.: 96,474

[22] Filed: Sep. 15, 1987

[30] Foreign Application Priority Data

Oct. 14, 1986 [GB] United Kingdom ..... 8624598

[51] Int. Cl.[4] ..... B22C 9/08

[52] U.S. Cl. ..... 164/359; 164/53; 164/360; 249/197

[58] Field of Search ..... 164/360, 359, 53; 249/82, 106, 197

[56] References Cited

U.S. PATENT DOCUMENTS

| | | | |
|---|---|---|---|
| 1,893,206 | 1/1933 | Messler et al. | 249/106 X |
| 2,612,667 | 10/1952 | Gombosh | 249/106 |
| 2,745,154 | 5/1956 | Lucien et al. | 164/359 |
| 2,821,758 | 2/1958 | Vallak | 249/106 X |
| 3,815,665 | 6/1974 | Baur | 164/360 X |
| 4,279,400 | 7/1981 | Greenberg | 249/106 |
| 4,423,762 | 1/1984 | Trinkl et al. | 164/360 X |
| 4,467,858 | 8/1984 | Trinkl et al. | 164/360 |
| 4,574,869 | 3/1986 | Trinkl et al. | 164/360 |

FOREIGN PATENT DOCUMENTS

| | | | |
|---|---|---|---|
| 0060348 | 7/1987 | European Pat. Off. . | |
| 766738 | 9/1980 | U.S.S.R. | 249/197 |
| 921332 | 3/1963 | United Kingdom | 164/53 |

OTHER PUBLICATIONS

"Design Method for Tapered Riser Feeding of Ductile Iron Castings in Green Sand", R. W. Heine, AFS Transactions 82-20, pp. 147-158.

Foseco Leaflet FA 17/2 for "Kalminex S"; admitted prior art.

*Primary Examiner*—Nicholas P. Godici

*Assistant Examiner*—J. Reed Batten, Jr.

*Attorney, Agent, or Firm*—Nixon & Vanderhye

[57] ABSTRACT

A feeder sleeve (1') for use in the casting of molten metal has a cavity (8) whose cross-sectional area at the bottom of the cavity (8) is greater than the cross-sectional area at the top of the cavity (8) such that a line joining a point (11.1) on the inner surface (11) of the sleeve at the bottom of the cavity (8) and the nearest point (11.2) on the inner surface (11) of the sleeve at the top of the cavity (8) is less than 80° to the horizontal. The inner surface of the sleeve may taper from the bottom of the cavity to the top of the cavity uniformly or in at least one step (12).

11 Claims, 3 Drawing Sheets

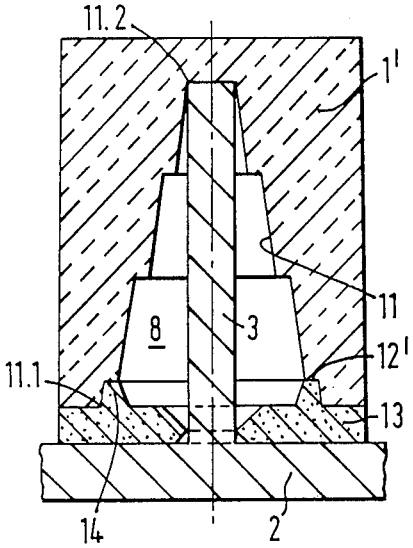
FIG. 5.
FIG. 6.
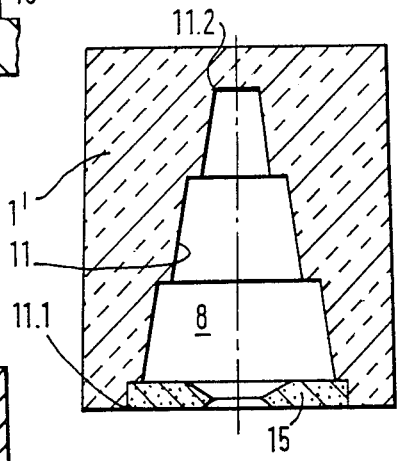
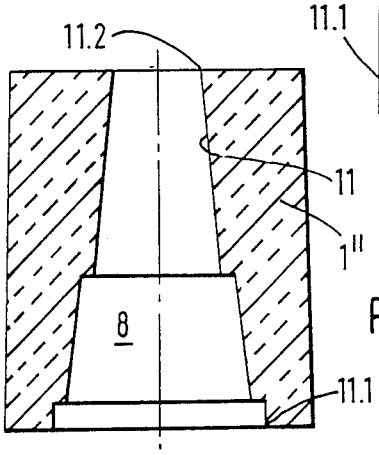
FIG. 7.

FEEDER SLEEVES

This invention relates to feeder sleeves for use in the casting of molten metals.

During solidification cast metals undergo a reduction in their volume. For this reason, in the casting of molten metals into moulds it is usually necessary to employ feeder heads located above or at the side of the castings in order to compensate for the shrinkage which occurs when the castings solidify. It is common practice to surround a feeder head with an exothermic and/or thermally insulating feeder sleeve in order to retain the feeder head metal in the molten state for as long as possible and thereby to improve the feeding effect and to enable the feeder head volume to be reduced to a minimum.

Such feeder sleeves are usually of circular or oval cross-section and are of one of two types, namely open feeder sleeves whose upper end is open to the atmosphere when the sleeve is in position in a mould or blind feeder sleeves whose upper end is closed and which are completely surrounded by moulding sand.

In order to facilitate their manufacture or to adapt the sleeve for certain methods of application it is common for feeder sleeves to be slightly tapered on their inner and/or their outer surface from the bottom of the sleeve to the top. In the case of the inner surface the degree of taper has usually been made as small as possible so as to minimise the reduction in volume of the feeder cavity and hence minimise the reduction in modulus of the feeder and its feeding efficiency.

A number of different methods for incorporating feeder sleeves in sand moulds are practised.

In one such method a feeder sleeve is located prior to moulding on a support fixed firmly to a casting pattern, or when the mould is to have a side feeder on a support fixed firmly to an extension of the casting pattern. After production of the mould the support is removed so as to produce a feeder cavity surrounded by the sleeve, which is held firmly in place by the material of the mould.

In another method a cavity is formed in the mould by means of a tapered pattern, and a feeder sleeve whose outer surface has a taper from bottom to top corresponding to the taper of the pattern is then inserted into the cavity.

In both methods the feeder sleeves are subjected to severe mechanical forces. Because of the increased quality demands being made by the foundry industry and the resultant need to produce moulds of greater strength new moulding machines have been introduced and these machines compact the sand to produce the mould under very high pressures. In the most recently introduced method of high pressure moulding the mould is produced by impact compaction by means of a gas explosion. Such methods of mould production subject the feeder sleeves to greater forces compared with older methods of mould production and deformation and even fracture of the sleeve can often occur.

Figure 1:
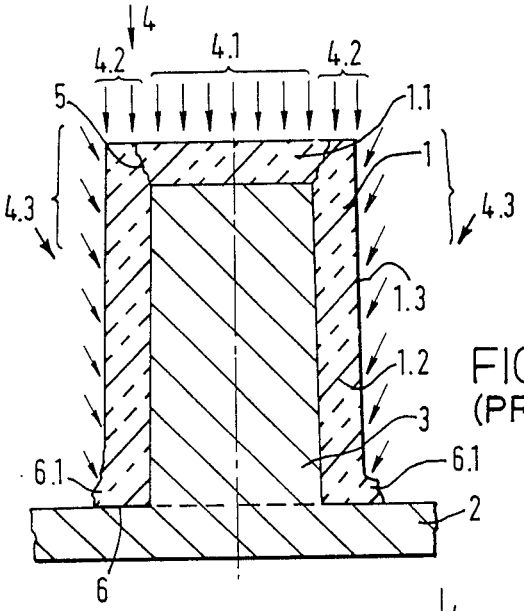
FIG.1. (PRIOR ART)

FIG. 1 of the accompanying drawings is a vertical section through part of a sand mould produced by high pressure compaction and illustrates how deformation and fracture of a feeder sleeve occurs. A feeder sleeve (1) stands on a pattern plate (2) and is supported internally by means of a support (3) fixed to the pattern plate (2). The support (3) also serves to locate the sleeve in its correct position. During compaction of the moulding sand around the feeder sleeve (1) the sleeve is subjected to forces denoted by arrows (4). The forces 4.1 striking the central part of the feeder sleeve cover (1.1) are absorbed by the support (3). The forces 4.2 striking the sleeve cover (1.1) above the more or less vertical wall (1.2) of the sleeve (1), and the forces 4.3 striking the outer surface (1.3) of the sleeve (1) cause a crack (5) to be formed in the cover (1.1) in the vicinity of the edge of the top surface of the support. Furthermore because the vertical wall (1.2) is stressed due the combined effect of forces 4.2 and 4.3 the wall (1.2) is deformed at its bottom end (6) producing a bulge (6.1).

Figure 2:
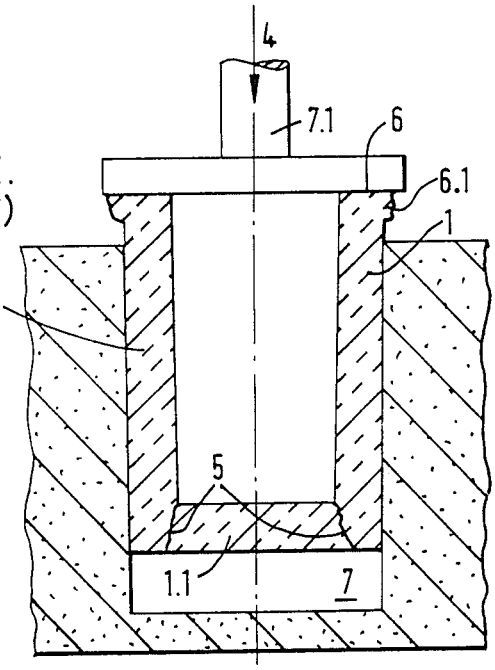
FIG. 2. (PRIOR ART)

FIG. 2 of the accompanying drawings shows schematically a feeder sleeve being inserted in a preformed cavity in a sand mould. A feeder sleeve (1) is pushed into a slightly undersize preformed cavity (7) by means of a tool (7.1) and is held firmly by the moulding sand. When the mould has been produced by means of a high pressure moulding process a greater force denoted by the arrow 4 is needed to push the sleeve (1) into the cavity (7) and as a result cracking in the cover (1.1) as indicated at 5 and deformation of the wall (1.2) at the bottom end (6) of the sleeve as indicated at 6.1 can occur.

Damage to feeder sleeves such as that described above has led to increased scrapping of metal castings. Attempts have been made to overcome the problem by making feeder sleeves stronger, but other problems have resulted. For example, sleeves can be made stronger by incorporating larger quantities of a bonding agent but this leads to metallurgical and environmental problems. Sleeves can also be made stronger by the use of more ressure resistant refractory materials but this results in the sleeves having a higher density and hence a higher thermal conductivity and as a result the feeding efficiency of the sleeves is reduced.

It has now been found that feeder sleeves which are suitable for use in conjunction with high pressure moulding processes can be produced by making the internal surface of the sleeve taper considerably from the bottom end of the sleeve to the top.

According to the invention there is provided a feeder sleeve having a cavity whose cross-sectional area at the bottom of the cavity is greater than the cross-sectional area at the top of the cavity wherein a line joining a point on the inner surface of the sleeve at the bottom of the cavity and the nearest point on the inner surface of the sleeve at the top of the cavity is less than 80° to the horizontal.

The inner surface of the sleeve may taper uniformly from the bottom of the cavity to the top of the cavity but it is preferred that the inner surface of the sleeve tapers from the bottom of the cavity to the top of the cavity in at least one step.

When the sleeve has one or more steps the laterally extending face of the steps may be horizontal or sloping at an angle to the horizontal and the longitudinally extending face may be vertical or tapered from bottom to top. When the sleeve is to be located in a mould on a support of similar configuration to the internal configuration of the sleeve it is preferred that the longitudinal face of the steps has at least a slight taper from bottom to top to enable the support to be withdrawn after production of the mould.

The perimeter of the inner surface of the feeder sleeve may be for example, circular, oval, square or rectangular.

The outer surface of the feeder sleeve may be vertical, tapered from the bottom of the sleeve to the top or tapered from the top of the sleeve to the bottom.

The shape of the outer surface of the sleeve is preferably such that the wall thickness of the sleeve adjacent the bottom of the cavity is less than the wall thickness of the sleeve adjacent the top of the cavity.

The sleeve may be open at its top end or it may be a so-called blind feeder sleeve which is closed at its top end by a cover, which may be for example flat or hemispherical and which may be formed integrally with the sleeve or fixed to the sleeve. The cover may have a Williams core formed integrally with or fixed to the underside of the cover in order to ensure that during solidification of the casting atmospheric pressure is exerted on the feeder metal so as to improve the feeding effect. If desired the cover may have an aperture which acts as a vent and allows gas to escape to the atmosphere during casting or the inner surface of the cover may have a recess from which a vent can be produced by removing sleeve cover material from above the recess prior to use of the sleeve.

The feeder sleeve of the invention may be formed from exothermic, heat-insulating or exothermic and heat-insulating material.

The sleeves of the invention are better able to resist the high forces to which they are subjected during high pressure moulding or when they are inserted into preformed cavities in moulds produced by high pressure moulding than known sleeves.

In the former case a sleeve which tapers uniformly from bottom to top and is located on a support of similar shape is in contact with a large supporting face which can better resist the compaction forces than would be the case with a sleeve having a more or less vertical face where the more or less vertical support would be less able to support the sleeve against vertical compaction forces. The effective area of the supporting face can be even further increased by the use of a sleeve whose internal surface has one or more steps and the steps have the added effect of keying into the surrounding feeder sleeve wall.

The feeder sleeves of the invention may be used in conjunction with a breaker core and depending on the design of the breaker core the resistance of the sleeves to compaction forces may be further increased. For example a stepped sleeve may have a breaker core having a flange on its upper face inserted in the bottom of the cavity so that the bottom step of the sleeve is supported on the flange, or a breaker core may be inserted inside the bottom end of a stepped sleeve so that the bottom step is supported on part of the upper face of the breaker core.

Sleeves according to the invention having a high degree of taper from bottom to top on their inner surface and particularly stepped sleeves of the type described, also have an improved feeding efficiency compared with conventional sleeves made of the same materials and having substantially the same cross-sectional area at the bottom of the sleeve cavity and substantially the same external shape.

In addition stepped feeder sleeves according to the invention containing exothermic materials present sharp corners where heat is transferred very efficiently from the burning exothermic materials to the feeder metal and through which the beneficial effects of atmospheric pressure will assist the feeder process.

Figure 3:
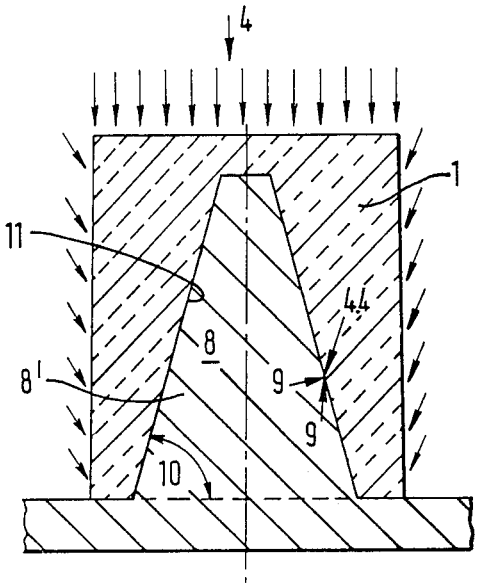
Figure 4:
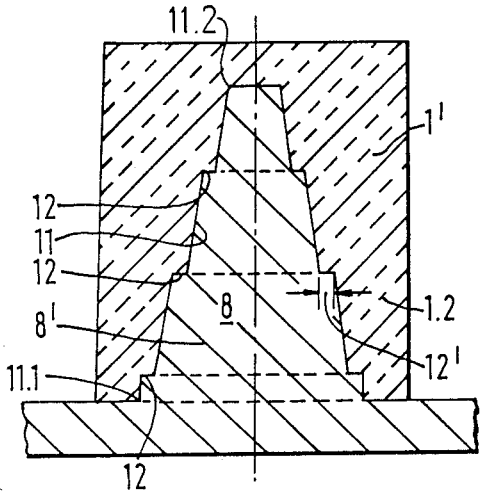

The invention is illustrated with reference to FIGS. 3–7 of the accompanying drawings in which:

FIG. 3 is a vertical section through part of a sand mould incorporating a feeder sleeve according to the invention FIG. 4 is a vertical section through part of a sand mould incorporating an alternative feeder sleeve according to the invention FIG. 5 is a vertical section through part of a sand mould incorporating a feeder sleeve similar to that shown in FIG. 4 and a breaker core FIG. 6 is a vertical section through a feeder sleeve according to the invention having a breaker core fixed inside its bottom end and FIG. 7 is a vertical section through a feeder sleeve illustrating a further embodiment of the invention.

In FIG. 3 a blind feeder sleeve (1) of circular horizontal cross-section has an internal cavity (8) whose cross-sectional area at the bottom of the sleeve (1) is greater than the cross-sectional area at the top of the cavity (8). The inner surface (11) of the sleeve (1) tapers uniformly from the bottom of the cavity to the top such that the angle (10) of the inclination to the horizontal of the surface (11) is 75°. The sleeve (1) is supported on a conical support (8′) and during high pressure compaction of moulding sand around the sleeve (1) compaction forces denoted by arrows 4.4 are counteracted by supportive and frictional forces denoted by arrows 9.

In FIG. 4 a feeder sleeve (1′) of circular horizontal cross-section and supported on a support (8′) has an inner surface (11) having steps (12). The steps (12) increase the effective supporting surface of the support (8′) and cause a keying effect in the surrounding feeder sleeve wall (1.2) when the mould is subject to high pressures. In practice it is preferred that the width (12′) of each of the steps is at least 5% of the diameter of the feeder cavity. A line joining point 11.1 on the inner surface (11) of the sleeve (1′) at the bottom of the cavity (8) and a point 11.2 on the inner surface (11) at the top of the cavity (8) is inclined at an angle of 73° to the horizontal.

In FIG. 5 a stepped feeder sleeve (1′) similar to that shown in FIG. 4 is used with a ceramic breaker core (13) to form an integral feeder system. A line joining point 11.1 on the inner surface (11) of the sleeve (1′) at the bottom of the cavity (8) and a point 11.2 on the inner surface (11) at the top of the cavity (8) is inclined at an angle of 73° to the horizontal. The sleeve (1′) is supported at its top end by a cylindrical support (3) anchored into a pattern plate (2). The breaker core (13) has a flange (14) which is in contact with the bottom step of the sleeve (1′). The width of the step (12′) and the flange (14) is preferably at least 5% of the diameter of the feeder aperture at its base so that consequently the degree of support of the sleeve (1′) is increased by at least (10%) compared with a similar sleeve having no breaker core.

In FIG. 6 a breaker core (15) is inserted into the bottom of the cavity (8) of a stepped feeder sleeve (1′) so that it is located on the bottom step thereby increasing the support of the sleeve 1′. A line joining point 11.1 on the inner surface (11) of the sleeve (1′) at the bottom of the cavity (8) and a point 11.2 on the inner surface (11) at the top of the cavity (8) is inclined at an angle of 74° to the horizontal.

In FIG. 7 a stepped feeder sleeve (1″) according to the invention is open at its top end as well as at its bottom end. A line joining point 11.1 on the inner surface

(11) of the sleeve (1″) at the bottom of the cavity (8) and a point 11.2 on the inner surface (11) at the top of the cavity (8) is inclined at an angle of 78° to the horizontal.

We claim:

1. A feeder sleeve having a cavity whose cross-sectional area at the bottom of the cavity is greater than the cross-sectional area at the top of the cavity wherein a line joining a point on the inner surface of the sleeve at the bottom of the cavity and the nearest point on the inner surface of the sleeve at the top of the cavity is less than 80° to the horizontal, and further wherein the inner surface of the sleeve tapers from the bottom of the cavity to the top of the cavity and comprises at least one step defined by longitudinally and laterally extending faces.

2. A feeder sleeve according to claim 1 wherein the laterally extending face of the step is horizontal.

3. A feeder sleeve according to claim 1 wherein the laterally extending face of the step is sloping at an angle to the horizontal.

4. A feeder sleeve according to claim 1 wherein the longitudinally extending face of the step is vertical.

5. A feeder sleeve according to claim 1 wherein the longitudinally extending face of the step is tapered from bottom to top.

6. A feeder sleeve according to claim 1 wherein the perimeter of the inner surface of the sleeve is circular, oval, square or rectangular.

7. A feeder sleeve according to claim 1 wherein the outer surface of the sleeve is vertical, tapered from the bottom of the sleeve to the top or tapered from the top of the sleeve to the bottom.

8. A feeder sleeve according to claim 1 wherein the shape of the outer surface of the sleeve is such that the wall thickness of the sleeve adjacent the bottom of the cavity is less than the wall thickness of the sleeve adjacent the top of the cavity.

9. A feeder sleeve according to claim 1 wherein the inner surface of the sleeve has a plurality of steps and the bottom step is supported on part of the upper face of a breaker core inserted in the bottom of the cavity.

10. A feeder sleeve having a cavity whose cross-sectional area at the bottom of the cavity is greater than the cross-sectional area at the top of the cavity wherein a line joining a point on the inner surface of the sleeve at the bottom of the cavity and the nearest point on the inner surface of the sleeve at the top of the cavity is less than 80° to the horizontal, wherein the inner surface of the sleeve tapers from the bottom of the cavity to the top of the cavity in a plurality of steps, and wherein a breaker core having a flange on its upper face is inserted in the bottom of the cavity so that the bottom step is supported on the flange.

11. A feeder sleeve according to claim 10 wherein the perimeter of the inner surface of the sleeve is circular and the width of the bottom step and the flange is at least 5% of the inner diameter of the sleeve at the bottom of the cavity.

* * * * *